US010155146B2

(12) United States Patent
McCredy

(10) Patent No.: US 10,155,146 B2
(45) Date of Patent: Dec. 18, 2018

(54) TENNIS COURT NET HEADBAND

(71) Applicant: Douglas D. McCredy, Toms River, NJ (US)

(72) Inventor: Douglas D. McCredy, Toms River, NJ (US)

( * ) Notice: Subject to any disclaimer, the term of this patent is extended or adjusted under 35 U.S.C. 154(b) by 0 days.

(21) Appl. No.: 15/709,744

(22) Filed: Sep. 20, 2017

(65) Prior Publication Data

US 2018/0099191 A1 Apr. 12, 2018

Related U.S. Application Data

(60) Provisional application No. 62/405,088, filed on Oct. 6, 2016.

(51) Int. Cl.
*A63B 61/00* (2006.01)

(52) U.S. Cl.
CPC ..... *A63B 61/003* (2013.01)

(58) Field of Classification Search
CPC ..... A63B 61/003; A63B 61/00
See application file for complete search history.

(56) References Cited

U.S. PATENT DOCUMENTS

| | | | | | |
|---|---|---|---|---|---|
| 4,895,366 | A * | 1/1990 | Bartasius | ..... | A63B 61/003 273/402 |
| 6,135,456 | A * | 10/2000 | Cooper | ..... | A63B 63/00 273/348 |
| 2007/0082763 | A1* | 4/2007 | Esser | ..... | A63B 61/003 473/459 |
| 2018/0099191 | A1* | 4/2018 | McCredy | ..... | A63B 61/003 |

* cited by examiner

*Primary Examiner* — Raleigh W Chiu
(74) *Attorney, Agent, or Firm* — Charles I. Brodsky

(57) ABSTRACT

A headband satisfying tennis association rules consisting of a first length of a nontransparent vinyl or fabric band coupled to a second, lower positioned length of transparent polyvinyl film of at least 100%-150% greater width in reducing the "blind spot" in overall tennis play.

20 Claims, 2 Drawing Sheets

TENNIS COURT NET HEADBAND

CROSS-REFERENCE TO RELATED APPLICATIONS

A Provisional Patent Application covering the invention described herein was filed on Oct. 6, 2016, and assigned Ser. No. 62/405,088.

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

Not Applicable

BACKGROUND OF THE INVENTION

Field of the Invention

This invention relates to tennis court nets, in general, in general, and to an advanced, improved headband for extension along the top of a tennis court net, in particular.

Description of the Related Art

As will be appreciated, the tennis court net is the single most important structure in tennis play, splitting the court into two equal halves. The net, forming a criss-cross pattern is the main obstacle in the game, and hitting the ball over the net is the cardinal rule of tennis. Suspended by net posts, the small square holes which define the net must be tiny enough so that the tennis ball cannot pass through the net, and the net must touch the ground so that the ball cannot travel under it. Being held down in the center by a white strap, the net also must have a cord or metal cable running along its top—which in accordance with tennis rules, must be covered by a white band.

Recognizing that a player's skill, quickness and power means nothing if he/she cannot properly land the tennis ball over the net and into the opponent's court, experience has shown that one of the problem areas is that the white band creates a "blind spot" through which the player is unable to see, in determining whether the ball struck properly lands in or out. In such circumstances, the player needs to rely on the opposing player's honesty in calling the shot as good or bad. Such "blind spot" follows from the white band (termed a "headband") being a nontransparent vinyl or fabric running along the top of the tennis court net, extending down on both its sides some 2½ inches.

OBJECT OF THE INVENTION

It is an object of the present invention, therefore, to provide an advanced and improved headband of this type in which the resultant "blind spot" is reduced, no matter where, on the court, the player hitting the ball may be located—in forecourt or at the base line.

It is another object of the invention to provide such a headband which can be easily replaced over time as the headband wears, or is tow in play.

It is a further object of the invention to provide such a headband for use whether the tennis court net is employed in indoor or outdoor play.

SUMMARY OF THE INVENTION

As will become clear from the following description, the headband of the invention will be seen to comprise a first length of nontransparent material and a second length of transparent material. Means are provided for coupling the transparent material with the nontransparent material so that the transparent material extends downwardly below the nontransparent material at least 100%-150% greater than the width of the nontransparent material. Means are also provided for coupling a bottom edge of the of transparent material along the top of the tennis court net.

In a first embodiment, a headband for extension along the top of a tennis court net in accordance with the invention includes a length of a nontransparent vinyl band having a top edge, a bottom edge, and a first width between them—and, a length of transparent vinyl film having a top edge, a bottom edge, and a second width between them greater than the first width. Means are included for joining the nontransparent band over the transparent film so that the greater width of the transparent film hangs down over both sides of the tennis court net. As described below, the transparent film is selected of a 5" width to drape some 2-2½" on each side of the net, the nontransparent band is selected of a 2" width, and 1½" visual overlay essentially results—150% greater than the width of the nontransparent vinyl band.

In a second embodiment of the invention for coupling to and along the top of the tennis court net, a length of transparent clear vinyl film is included as having a first top edge to bottom edge width, and a length of nontransparent vinyl or fabric band having a second lesser top edge to bottom edge width. Means, here, secure the nontransparent band equally spaced between the top edge and bottom edge of the transparent clear vinyl film, with the securement being such that folding the top edge of the transparent clear vinyl film over to the bottom edge of such material results in a lapping of the transparent clear vinyl film over the nontransparent band on both the top and the bottom. A 5" width for the transparent film is selected, along with a 2" wide band for the nontransparent material, so that the extent of visual overlay again is essentially 1½", 150% greater than the width of the nontransparent band.

Different arrangements can be used for securing the headband along the top of the tennis court net so as to have the headband replaceable or not, and also to enable the headband to be used indoors or outdoors—with an outdoors use being one where the transparent vinyl film could be selected to be glare resistant, ultraviolet resistant and/or fungal resistant as well.

BRIEF DESCRIPTION OF THE DRAWINGS

These and other features of the present invention will be more clearly understood from the following description, in which.

DETAILED DESCRIPTION OF THE INVENTION

Figure 1:
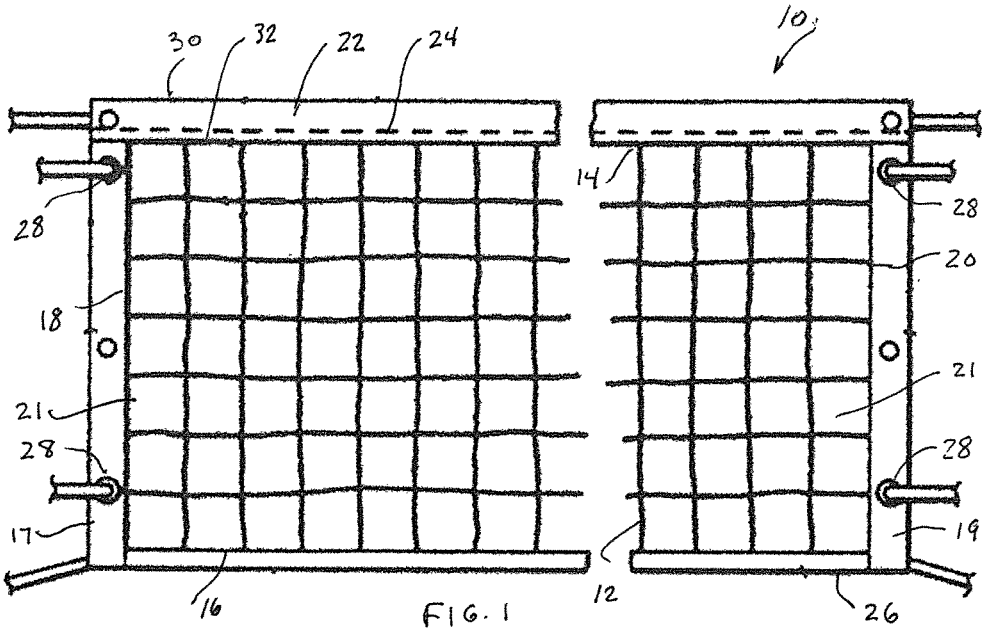
FIG. 1 PRIOR ART
FIG. 1 illustrates a conventional prior art manner of coupling a headband for extension along, and to, the top of a tennis court net.

In FIG. 1, the conventional tennis court net 10 includes a length of netting 12 having a top edge 14, a bottom edge 16, a first side edge 18, and a second side edge 20—with the side edges 18 and 20 being spaced apart from each other, joining the top edge 14 to the bottom edge 16. A headband 22, oftentimes formed of a vinyl-coated nylon or other fabric or thermoplastic material, is secured to the netting 12 by a cord or metal cable 24 running along a bottom edge 32 of the headband 22, adjacent the top edge 14 of the netting 12. A footband 26 typically is also provided at the bottom edge 16 of the netting 12, and marginal edge bands 17 and 19 may also be provided for the two side edges 18 and 20, respectively. Each marginal edge band 17, conventionally includes a grommet 28 through which re-enforcing wires or cables are drawn in coupling the net 10 to left and right side supports (not shown) to increase the rigidity of the net 10 during use. The small square holes 21 of the netting 12 are designed tiny enough so that a tennis ball cannot pass through them—and in accordance with tennis association rules, a strap (also not shown) holds down the net 10 at its center, measured left-to-right. Also in accordance with tennis rules, such strap is configured "white" in color, as is the headband 22.

In further accordance with these association rules, the headband 22 (from its top edge 30 to its bottom edge 32) is 2" to 2½" wide, extending along the top of the net 10. Experience has shown, however, that such width—whether composed of a white vinyl band or fabric or otherwise—creates a "blind spot" for players on each side of the net to determine whether the ball struck in play properly lands in or out of the court's field. In accordance with the present invention, on the other hand, the headband is of a different configuration and manner, so as to reduce such "blind spot" effect.

Figure 2:
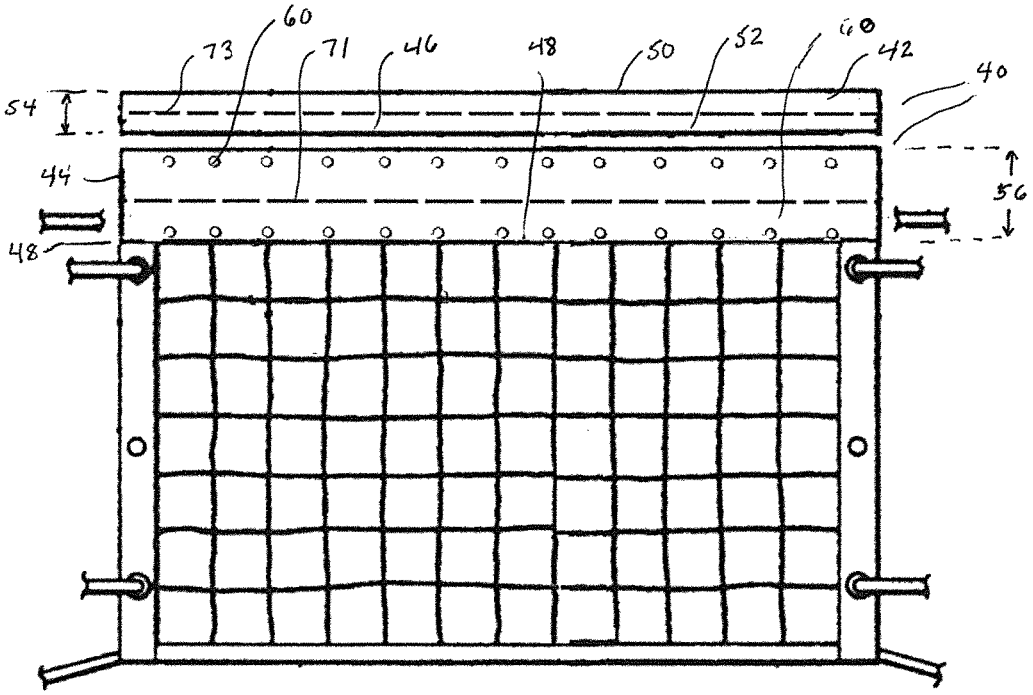
FIG. 2 is an illustration of a portion of a headband for such extension constructed in accordance with the first embodiment of the invention.

More specifically—in the first embodiment of FIG. 2—the headband 40 includes a length of a nontransparent vinyl band 42 of a first top-to-bottom width, and a length of a transparent vinyl film 44 of a second, greater top-to-bottom width. The top and bottom edges 46 and 48 of the transparent vinyl film 44 are secured at the top of the tennis court net when folded in half across the crease line 71 from top-to-bottom to drape over, onto the net. The top and bottom edges 50 and 52 of the nontransparent vinyl band 42 are secured onto the transparent vinyl film 44 when similarly and equally folded in half across the crease line 73 from top-to-bottom, over the transparent vinyl film 44. In accordance with the invention, the width of the vinyl film 44 is selected greater than that of the nontransparent vinyl band 42 so as to extend downwardly below the nontransparent vinyl band 42 substantially 100%-150% greater than the width of the nontransparent band 42.

In satisfying an objective of the invention to reduce the extent of the "blind spot" with a clear polyvinyl for the transparent vinyl film 44 and a nontransparent vinyl for the band 42 and to comply with tennis association rules, the width 54 of the nontransparent vinyl 42 is selected to be 2", while the greater width 56 of the clear polyvinyl 44 is selected to be 5". (In a preferred construction, the nontransparent vinyl band is colored "white", the transparent polyvinyl film 44 is stitched to the netting 12 by a black filament, and the nontransparent band 42 is stitched to the transparent film 44 by a clear or white filament. At the same time, either by decreasing the width of the nontransparent vinyl material, or increasing the width of the transparent clear material, the ratio of the widths between the two will be able to reduce the extent of the "blind spot", even more, i.e. by increasing the downward extension of the transparent material even more than the 100%-150% above relationship.)

For the folded over in half 2½" headband, a see-through width of some 1½" results below a 1" or so "white" visual marker for the net 10—with the respective widths being correspondingly reduced if the overall headband were to be manufactured of lesser width, or increased if the overall headband were to be manufactured of greater width. (While the folding over of the nontransparent and transparent materials 42, 44 cause a degree of "roundness" which prevents an exact 1½" see-through dimension forming, it allows for the insertion of a 0.3" diameter cord or metal cable between them for an added rigidity to the headband format. As such, when folded over, the transparent material extends substantially only some 100%-150% more than the width of the nontransparent band.)

Usable with a tennis court net for either indoor or outdoor play, and in accordance with the invention, the transparent polyvinyl film 44 can be composed of a glare resistant material, with or without ultraviolet resistance fabrication, and with or without a plurality of weep hole slits 60 spaced along the transparent polyvinyl film 44 for draining any condensate that may collect within the polyvinyl film 44 during tennis play in a heated, humid, or wet environment. Similarly, a "snapping" securement between the transparent polyvinyl film 44 and the nontransparent vinyl band 42 could be utilized instead of a "stitching" securement as described above.

Figure 3A:
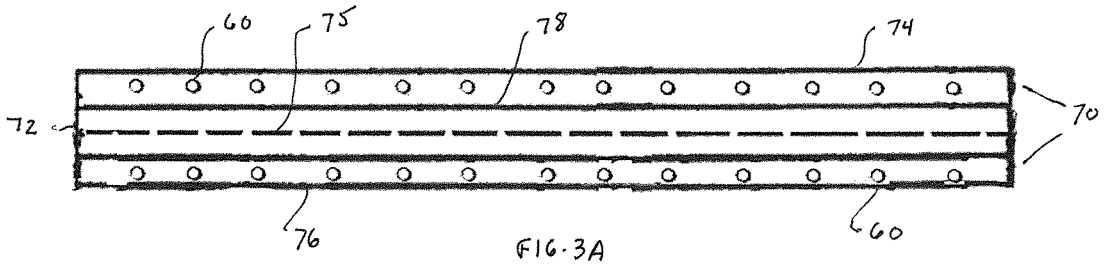
FIGS. 3A and 3B illustrate the headband of the invention for such extension along the top of the tennis court net in accordance with the second embodiment of the invention.
Figure 3B:
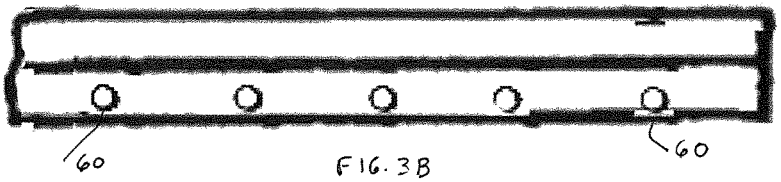

As an alternative to stitching the nontransparent vinyl band 42 to the transparent vinyl film 44 when draped over it in folding both in half from top to bottom, the embodiment of the invention shown in FIG. 3A begins with a 5" wide length of polyvinyl film 70. A 2" wide length of nontransparent white fabric or vinyl band 72 is overlain over and across the film 70, equally spaced between the top edge 74 and bottom edge 76 of the film, as shown at 78. Securing the nontransparent band 72 to the transparent polyvinyl film 70 underneath then allows for a folding over at the crease line 75 of the polyvinyl film 70 from top-to-bottom until its top edge 74 and bottom edge 76 meet, thereby folding over the nontransparent band 72 substantially in half as well. A finally formed headband of some 2½" width results for attachment over the top of the tennis net 10 on each side (FIG. 3B). The fold over and overlapping would reduce the "blind spot" once again (as in FIG. 2), providing a nontransparent top band of some 1" width hovering above a transparent bottom, film width of 1½". And, in this manner, a cord or metal cable can simply be guided through a loop spacing left when the polyvinyl film 70 is folded over onto the "white" nontransparent band 72 (especially if of a false composition), or underneath it.

Figure 4:
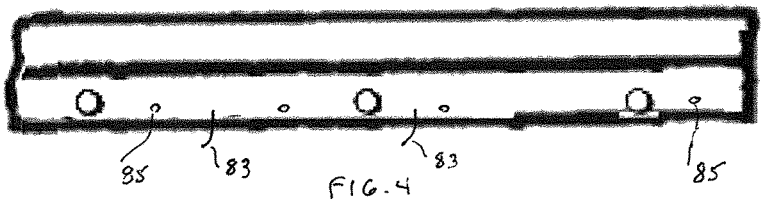
FIG. 4 illustrates different manners of coupling the headband of either the first or second embodiment with a conventional tennis court net.

Recognizing that headbands may wear or tear over time, the present invention also affords a manner of coupling them to the net other than by a conventional stitching—and thereafter replacing them. Similarly, an employment of snaps or hooks adjacent to the bottom edge of the headband can then be utilized to join at the top of the netting with similar manners of attachment. Such hooks or snaps are illustrated at 83, 85 in FIG. 4, although it will be readily appreciated that only one set of couplings (namely either hooks or snaps) would be utilizable in any one construction. In any event, and with the construction set forth above, the effect of the headband modification of the invention will be understood to reduce the "blind spot" existent in the course of tennis play.

While there have been described what are considered to be preferred embodiments of the present invention, it will be readily appreciated by those skilled in the art that modifications can be made without departing from the scope of the teachings herein. Thus, for example, while equal lengths of the nontransparent material and transparent material are preferable in construction, differing lengths may be used instead as long as the relationship in width is maintained—whether between 100%-150% or more. So, too, other nontransparent and transparent materials may be employed to provide similar advantageous effects as well. And as will be apparent, for thicker gauge vinyls or other materials utilized, the widths of the nontransparent materials may well need to be increased beyond the indicated sizes of 2" and 5" respectively, especially for greater diameter cords or metal cables used to provide rigidity to the headband.

For at least such reasons, therefore, resort should be had to the appended claims for a true understanding of the invention.

I claim:

1. A headband for extension along the top of a tennis court net comprising:

a first length of nontransparent material of a first width;

a second length of transparent material of a second width;

means for coupling said second length of transparent material about a top of the tennis court net; and means for coupling said second length of transparent material with said first length of nontransparent material to extend said second length of transparent material downwardly below said first length of nontransparent material at least 100%-150% greater than said first width of said first length of nontransparent material.

2. A headband of claim 1 wherein both said first length of nontransparent material and said second length of transparent material are folded over for coupling onto the top of the tennis court net.

3. The headband of claim 2 wherein said second length of transparent material is 100%-150% wider than said first length of nontransparent material after the respective fold over of each material.

4. The headband of claim 3, wherein said first length of nontransparent material is composed of a vinyl band, wherein said second length of transparent material is composed of a polyvinyl film, and wherein a plurality of weep hole slits are spaced along said second length of transparent material for draining condensate collecting within said second length of transparent material during tennis play.

5. The headband of claim 4 wherein said second length of transparent material is composed of a glare resistant polyvinyl film.

6. The headband of claim 4 wherein said second length of transparent material is composed of an ultraviolet resistant polyvinyl film.

7. The headband of claim 2 wherein said second length of transparent material is some 1½ inches wide and said first length of nontransparent material is some 1 inch wide after the respective fold over of each materials.

8. The headband of claim 2 wherein said first length of nontransparent material is composed of a vinyl band.

9. The headband of claim 2 wherein said second length of transparent material is composed of a polyvinyl film.

10. The headband of claim 9 wherein said first length of nontransparent material is composed of a vinyl band.

11. The headband of claim 10 wherein a bottom edge of said second length of transparent material is adapted to couple to the top of the tennis court net by one of a plurality of hooks or snaps, or by stitching.

12. The headband of claim 10 wherein said first length of nontransparent material is composed of a white vinyl band.

13. A headband for extension along the top of a tennis court net comprising:

a first length of transparent polyvinyl having a first top edge and bottom edge, and a first top edge to bottom edge width;

a second length of nontransparent vinyl or fabric having a second top edge and bottom edge; and a lesser, second edge to bottom edge width equally spaced onto and between said top edge and said bottom edge of said first length of transparent polyvinyl;

means securing said second layer of nontransparent vinyl or fabric onto said first layer of transparent polyvinyl such that folding said top edge of said first length of transparent polyvinyl over said second length of nontransparent vinyl or fabric to reach said bottom edge of said first length of transparent polyvinyl results in an overlying of said first length of transparent polyvinyl below said length of nontransparent vinyl or fabric on opposing sides of both said lengths, and with said overlying being greater than a folded-over width of said second length of nontransparent vinyl or fabric.

14. The headband of claim 13 wherein said overlying is at least 1½ inches.

15. The headband of claim 13 wherein said first length of transparent polyvinyl is of a substantially 5 inch width.

16. The headband of claim 13 wherein said first length of transparent polyvinyl is of a substantially 5 inch width and wherein said second length of nontransparent vinyl or fabric is of a substantially 2 inch width.

17. The headband of claim 16 wherein said first length of transparent polyvinyl is of a durable, non-glare, ultraviolet resistant composition.

18. The headband of claim 13 wherein said bottom edge and folded over top edge of said first length of transparent polyvinyl are adapted to couple to the top of the tennis court net by one of a stitching, hooking, and snapping means.

19. A tennis court net comprising:

a length of netting having a top edge, a bottom edge, a first side edge, and a second side edge spaced apart from said first side edge;

and a headband extending along said top edge of said netting having a first length of nontransparent material of a first width, a second length of transparent material of a second width, means for coupling said second length of transparent material about said top edge of said netting, and means for coupling said second length of transparent material with said first length of nontransparent material to extend said second length of transparent material downwardly from said top edge of said netting, and below said first length of nontransparent material at least 100%-150% greater than said first width of said first length of nontransparent material.

20. The tennis court net of claim 19 wherein said first length of nontransparent material is composed of a white colored vinyl or fabric band and wherein said second length of transparent material is composed of a clear polyvinyl film.

* * * * *